US005651739A

United States Patent [19]

Carlsen

[11] Patent Number: 5,651,739

[45] Date of Patent: Jul. 29, 1997

[54] MACHINE FOR FORMING A HEAD ON A SHANK, SUCH AS A NAIL

[75] Inventor: Jens Bregnar Carlsen, Middelfart, Denmark

[73] Assignee: Encotech A/S, Skanderborg, Denmark

[21] Appl. No.: 401,710

[22] Filed: Mar. 10, 1995

[51] Int. Cl.[6] ..... B21K 1/46

[52] U.S. Cl. ..... 470/129; 470/137

[58] Field of Search ..... 470/27, 33, 38, 470/137, 140, 129

[56] References Cited

U.S. PATENT DOCUMENTS

| | | | |
|---|---|---|---|
| 1,024,046 | 4/1912 | Weeks | 470/137 |
| 2,124,022 | 7/1938 | Alberts | 470/137 |
| 5,050,260 | 9/1991 | Nielsen | 72/195 |

*Primary Examiner*—Lowell A. Larson
*Assistant Examiner*—Thomas C. Schoeffler
*Attorney, Agent, or Firm*—Ladas & Parry

[57] ABSTRACT

A machine for producing e.g. nails by providing oblong shanks (3) with an enlarged heads in one end (4) thereof comprising a rotatably tool ring (2) having a plurality, of holding tools for in one angle position during rotation of the tool ring receiving the shanks, and in another angle position securing the shanks so that they extend radially of the tool ring with each shank having its said end protruding inside the tool ring. Said machine also comprising a rotatably roll (1) mounted inside the tool ring at the securing position of this and adapted for deforming said protruding end of the shanks successively to provide enlarged heads thereon. Said machine further comprising a bending device (25) mounted between the receiving position and the rotatably roll for bending the protruding end of the shanks. Thus the machine according to the invention is able to provide on shanks enlarged heads having larger diameter in proportion to the diameter of the shank than known before.

13 Claims, 7 Drawing Sheets

MACHINE FOR FORMING A HEAD ON A SHANK, SUCH AS A NAIL

FIELD OF INVENTION

The invention concerns a machine for producing e.g. nails by providing oblong shanks with an enlarged head in one end thereof, wherein said machine is of the type comprising a rotatable tool ring bounding a substantially cylindrical space and having a plurality of holding tools for in one angle position during rotation of the tool ring receiving the shanks, and in another angle position securing the shanks so that they extend substantially radially of the tool ring with each shank having its said end protruding into said cylindrical space, and said machine also comprises a rotatable roll mounted in the cylindrical space of the tool ring at the securing position of this adapted for deforming said protruding end of the shanks successively to provide enlarged heads thereon.

BACKGROUND OF INVENTION

U.S. Pat. No. 5,050,260 discloses such a machine. This known machine forms excellent enlarged heads on the protruding end of the shanks when the proportion between the length of said protruding end and the diameter of the shanks does not exceed a factor of about 2.5 and when the proportion between the diameter of the formed enlarged head and the diameter of the shanks does not exceed a factor of about 2.5. Concerning e.g. nails, for some applications, however, it is necessary with heads with such a large diameter that the proportion between the diameter of the head and the diameter of the shank will exceed the factor of 2.5. In these cases the protruding end must be so long that the proportion between its length and the diameter of the shanks also will exceed the factor of 2.5. This means that the protruding end of the shanks now will be so long that the end is liable to bend when engaging the rotating roll instead of being clenched properly to the wanted head.

SUMMARY OF THE INVENTION

The object of the invention is therefore to provide a machine of, the type mentioned in the opening paragraph, which is able to provide, on shanks, heads having larger diameter in proportion to the diameter of the shank than known before.

This object is obtained in the machine of the invention comprising a bending device mounted between the receiving position and the rotatable roll in said cylindrical space for bending the protruding end of the shanks. When the protruding end engage the roll, the end will be acted on by a force from the roll in a direction forming an angle with the axis of the shank. The end will therefore be somewhat bended, but if the protruding end in proportion to the diameter of the shank is not too long, as normally is the case, the end nevertheless can be clenched to the wanted head. If, on the other hand, the length of the protruding end is too big the end will instead be bended so much that a defect head is formed. To avoid this drawback the protruding end is, according to the invention, bended at an angle turning into the same direction as the rotary direction of the tool ring before engaging the roll. The angle between the protruding end and the direction of the acting force from the roll then is decreased with said bending angle. By choosing the size of the bending angle in dependence of the length of the protruding end and of the diameter of the shank, the protruding end will no more be liable to bend too much but can readily be formed to a perfect head having a big diameter.

Choosing bending angles between 5 and 45 degrees, and preferably between 5 and 15 degrees, has been found to give expedient conditions in forming on shanks heads having very big diameters.

The bending of the protruding end of the shanks may be performed by means of a punch situated close to the roll where the shanks safely are secured and therefore do not move when acted on by the punch.

In a simple embodiment the punch can be a radially extending projection on a shaft rotating synchronously with the conveying of the shanks so that the punch always will hit the protruding end to be bended in the same position.

In a preferred embodiment the punch can be mounted on a guiding device, e.g. a link motion to impart a mainly reciprocating movement to the punch synchronously with the conveying of the shanks. This guiding device then may be adapted to move the punch between a position where the punch act on the protruding end of a shank, and another position where the punch goes clear of the shanks coming from behind the punch.

To get the shanks to protrude sufficiently long into the cylindrical space of the tool ring, i.e. longer than normal, there can be mounted a pushing device outside the outer periphery of the tool ring for pushing on the rear end of the shanks. In this way the shanks can be pushed further into said cylindrical space than normally possible for the conventional feeding devices for inserting the shanks into the tool ring.

It is well known that spreading of the material of the protruding end of a shank to form a well-defined head requires the peripheral speed of the roll to be greater than the conveying speed of the heads or of the inner periphery of the tool ring. The reason is that the roll in this way will drag some of the material into the rotating direction while the clenching power from the roll will act somewhat in the opposite direction.

The difference of velocities is normally about 20%, but this is too much when the protruding end of the shank is pre-bent as the roll then will drag too much material in the rotating direction so that the head consistently will not achieve the desired form.

When using the machine of the invention for forming on shanks enlarged heads with greater diameters than normally possible for conventional rotary machines, the circumferential velocity of the roll should advantageously be between 0% and 12% more than the conveying velocity of the enlarged head of the shanks.

BRIEF DESCRIPTION OF THE DRAWING

The invention will be explained more fully by the following description of preferred embodiments, which are given by way of example and form no limitation in the scope of protection of the invention, with reference to the drawing, in which.

DETAILED DESCRIPTION

The following description concerns the providing of heads on nails. This, however, only serves as an example, and the machine can as well be used for forming heads on e.g. screws or bolts.

The basis principle for forming such heads is known from U.S. Pat. No. 5,050,260 and is characterized in that the shanks are worked by so-called internal rolling.

Figure 1:
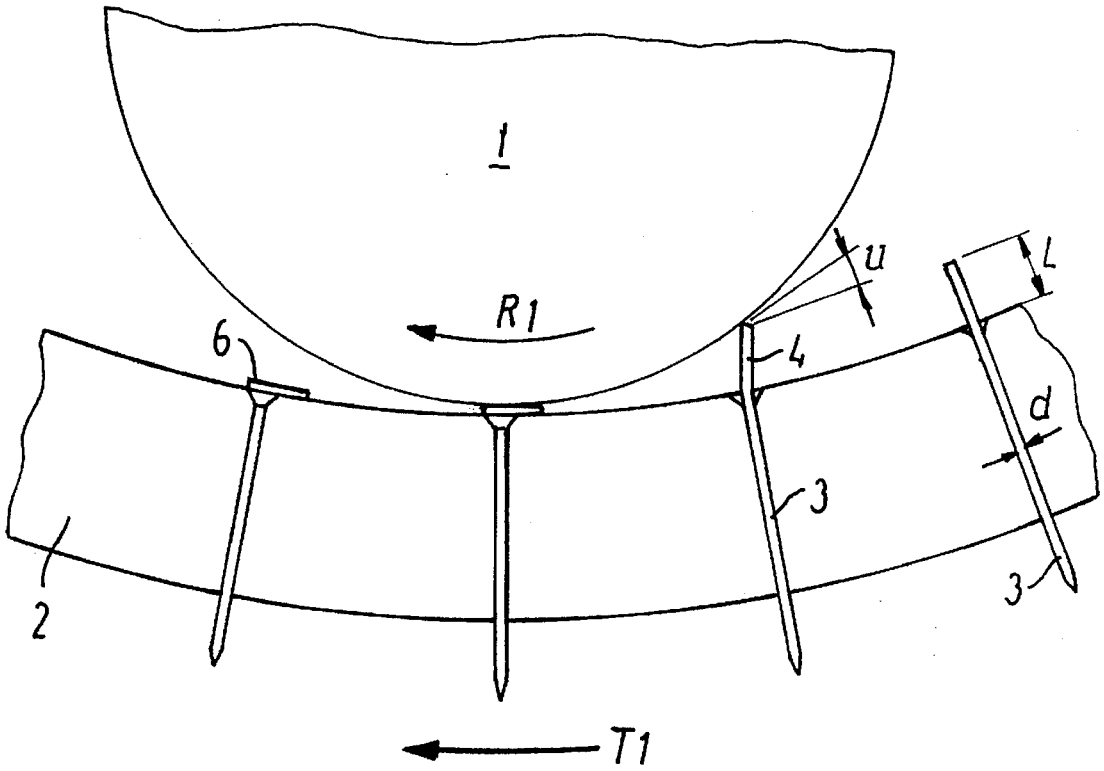
FIG. 1 is a sketch of the principle for forming on a shank an enlarged head having greater diameter than usually possible when using a conventional rotary machine.
Figure 2:
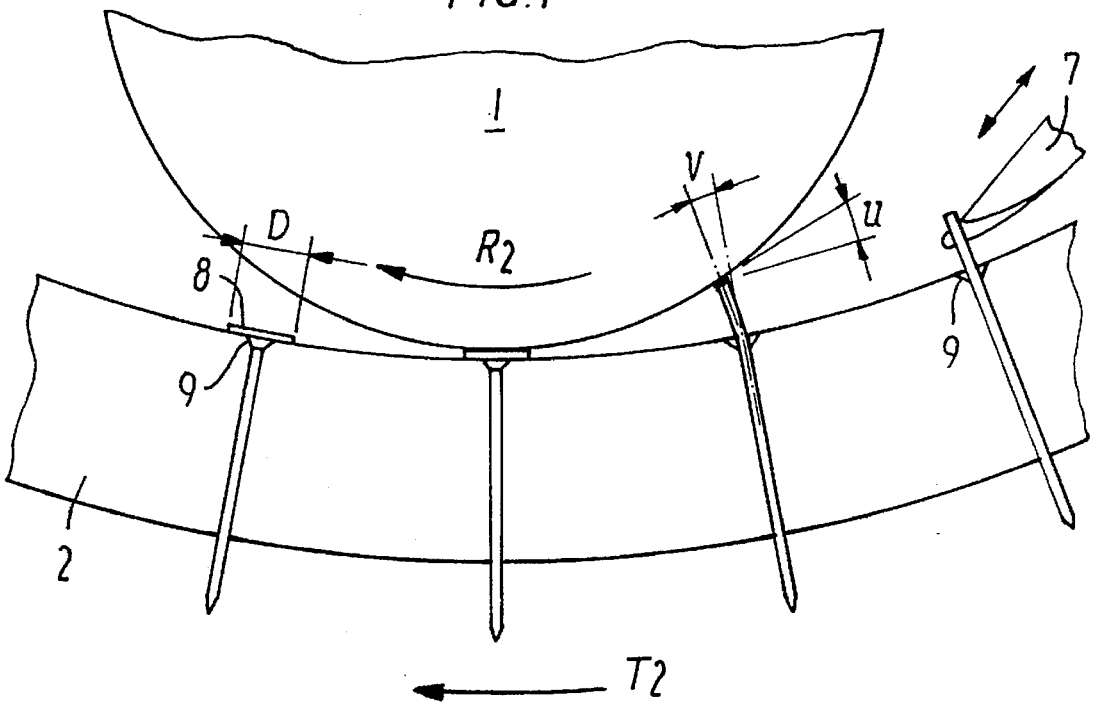
FIG. 2 is a sketch of the same principle, but when using a machine according to the invention.

This process is illustrated in FIG. 1 and 2 where FIG. 1 schematically shows the process when using a conventional rotary machine, e.g. the above named known machine, and FIG. 2 schematically shows the process when using a machine according to the invention.

In FIG. 1 a roll 1 revolves in the direction of the arrow with the peripheral velocity R1 when the machine is operating. A tool ring 2 rotates simultaneously in the direction of the arrow with the peripheral velocity T1. In the tool ring 2 there is secured with equal spacing a number of shanks 3, each having a protruding end 4 extending into the cylindrical space 5 inside the tool ring. The length of the protruding end 4 is 1, and the diameter of the shank 3 is d. The diameter of the head is D (FIG. 2).

When the protruding end 4 engages the roll 1 it will bend rearwardly as shown in FIG. 1 where a conventional rotary machine is used. In such machines the peripheral velocity R1 of the roll is greater than the peripheral velocity T1 of the tool ring. The difference between the two velocities is normally about 20%.

Even though the material in the protruding end 4 is asymmetrically distributed at the beginning where the end hits the roll and is bent rearwardly, there could be formed a symmetrical head or an offset head as the frictional forces acting between the protruding end and the roll will drag some material the opposite way of the bending since the peripheral velocity of the roll is greater than the peripheral velocity of the tool ring.

Thus the conventional rotary machine is able to produce nails with symmetrical heads or offset heads when there, however, have not too big a diameter, and consequently the protruding end of the shank is not too long.

Practically D/d and l/d must both not exceed a factor of about 2.5. If this limitation is not observed the protruding end will be too long. As seen in FIG. 1, the end now will be bent, so much when engaging the roll that the frictional forces acting between the protruding end and the roll no longer will be able to drag sufficient material the opposite directions of the bending to counterbalance the highly unequal distribution of the material in this bending. As result a defect head 6 is formed.

An important parameter in this forming process is the acute angle u of entry, defined as the angle between the tangent to the roll 1 at the point where it initially hits the protruding end 4 and the tangent to the tool ring 2 at the point where the shank is secured in the tool ring.

The angle u also is the angle under which the force from the roll 1 is acting on the protruding end 4 of the shank 3 and if this angle is too big, as is the case in FIG. 1 where the proportion l/d is more than 2.5, the protruding end will be bent so much that an efficient and well-defined spreading of the material is not possible and instead the material will be spread to a defect form like the head 6.

FIG. 2 corresponds to FIG. 1 and shows a roll 1, a tool ring 2 and shanks 3 secured in the tool ring 2. The length l of the protruding end 4 is the same as in FIG. 1.

In this case, however, the protruding end is pre-bent in the rotating direction by means of a reciprocating punch 7. The angle u now is reduced with the bending angle v so the force from the roll will act on the protruding end of the shank only under the angle u minus v. With this reduction of the acting angle it is possible to produce expedient enlarged heads 8 even if D/d>2.5 and l/d>2.5. This means that with the machine, according to the invention, it now is possible to produce e.g. nails with very big, flat heads. In FIG. 2 symmetrical heads of this kind are by way of example illustrated. The big heads mainly are flat but with a little conical part formed in a mold cavity 9.

When the protruding end is pre-bent, as in FIG. 2, the material is bendt the same way as the frictional forces between the protruding end and the roll are acting. Consistently the roll now will not have to drag so much of the material in the protruding end in the rotating direction as in the conventional rotary machines.

In the machine of the invention the peripheral velocity R2 of the roll 1 still must be greater than the peripheral velocity T2 of the tool ring 2. The difference between the two velocities, as normally is about 20%, should, however, in this case now be not more than between 0% and 12%.

Figure 3:
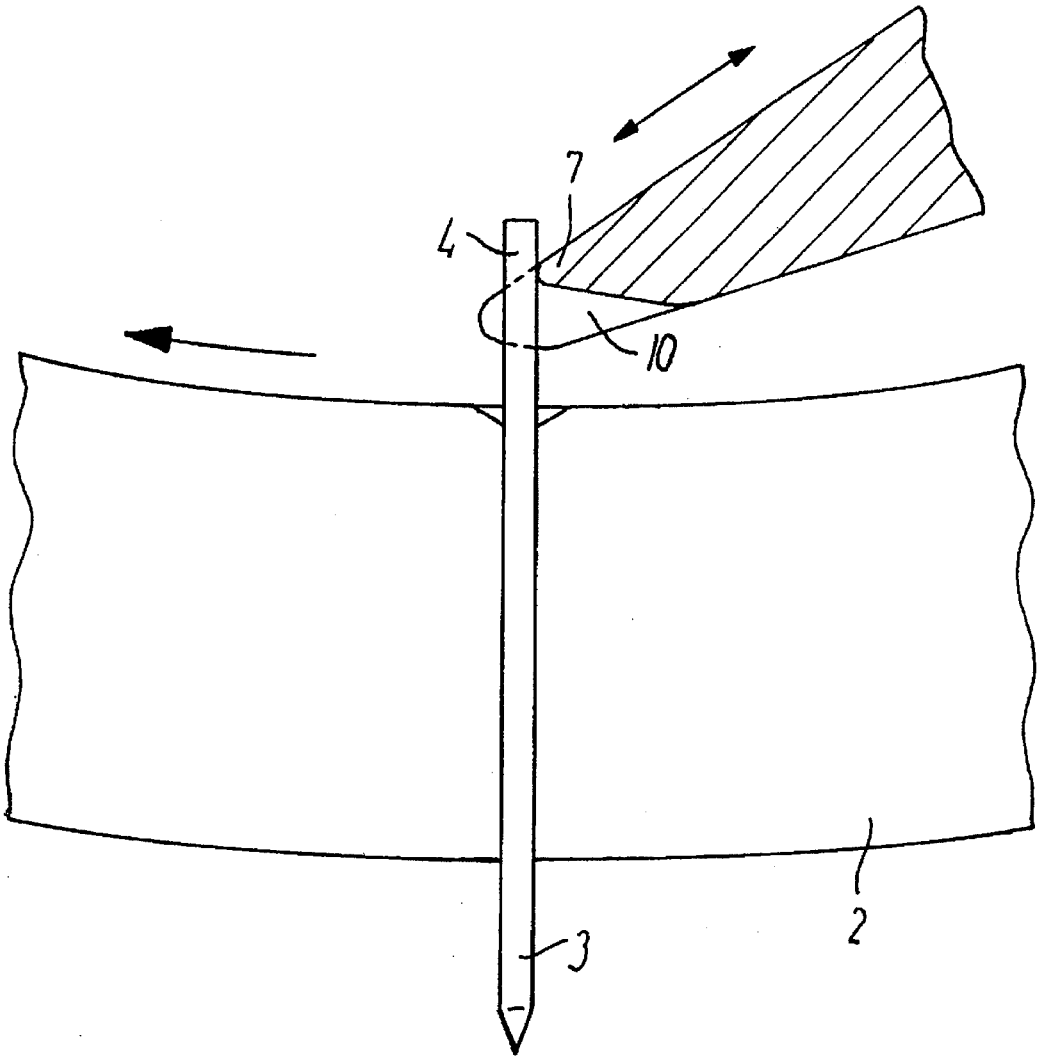
FIG. 3 is a partial, vertical view in greater scale of a tool ring with the protruding end of a nail to be bended by a punch.
Figure 4:
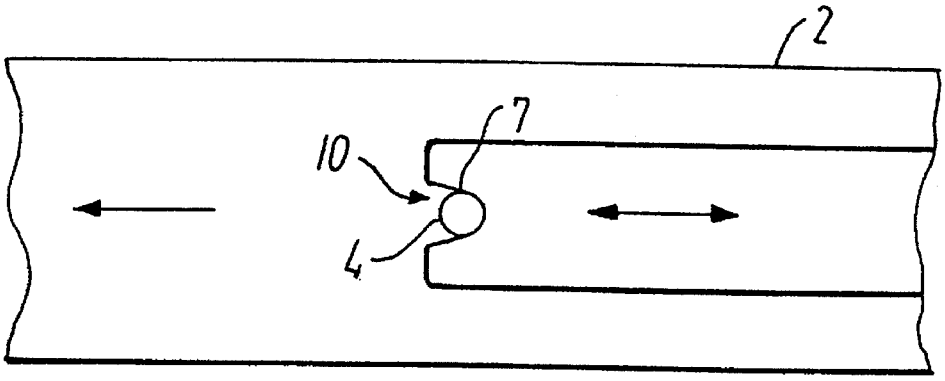
FIG. 4 is a top view of the same.

FIG. 3 and 4 show, partially in section, in greater scale the construction of the punch 7. The punch has just engaged the protruding end 4 of the shank 3 secured in the tool ring 2 for bending said end. The nose of the punch is formed with a groove 10. This groove serves to retain the protruding end against bending in a direction transversely to the rotating direction. For safely catching of the end the groove is diverging in the rotating direction.

Figure 5:
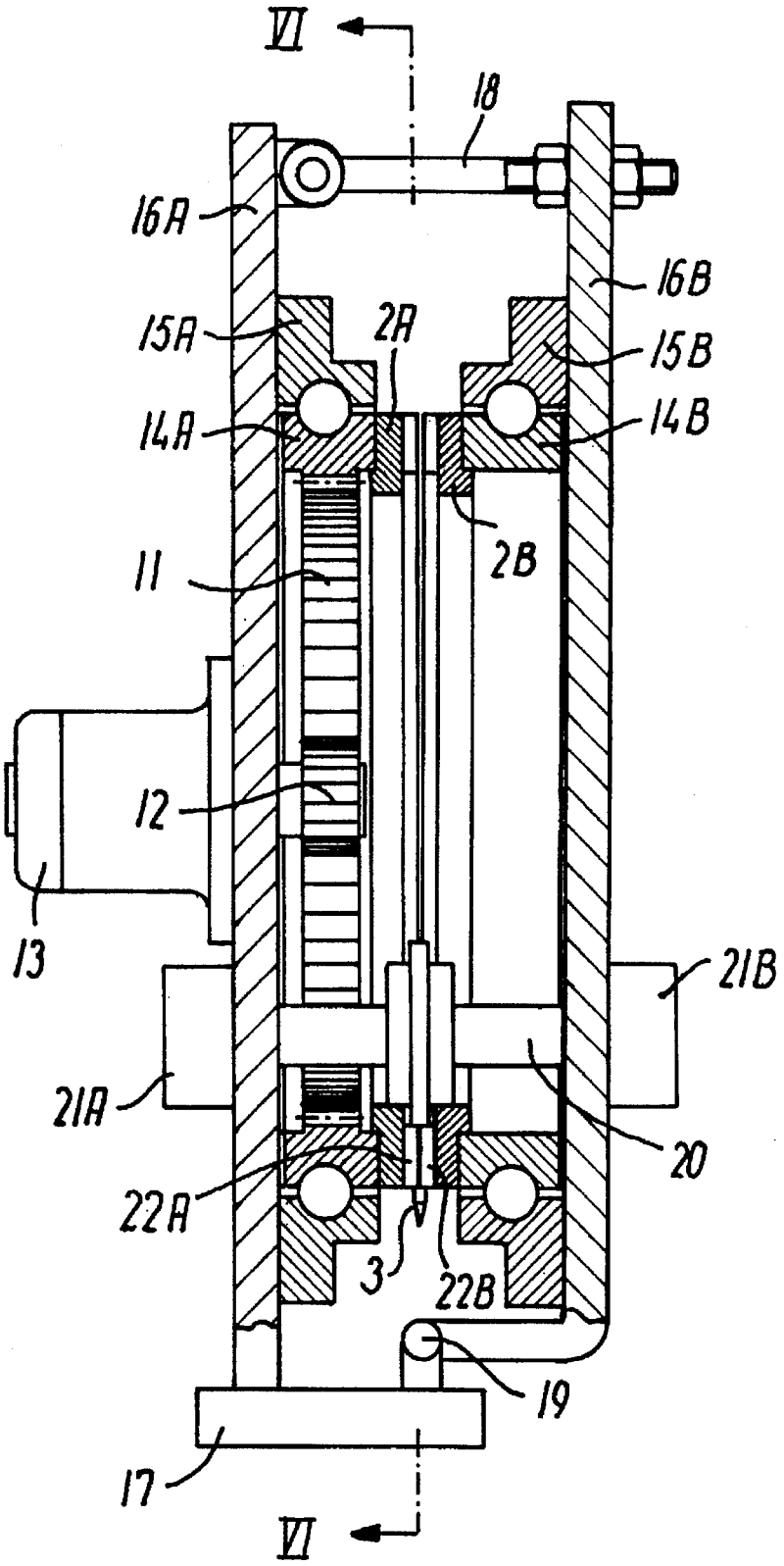
FIG. 5 shows the machine according to the invention in a vertical, transverse sectional view.
Figure 6:
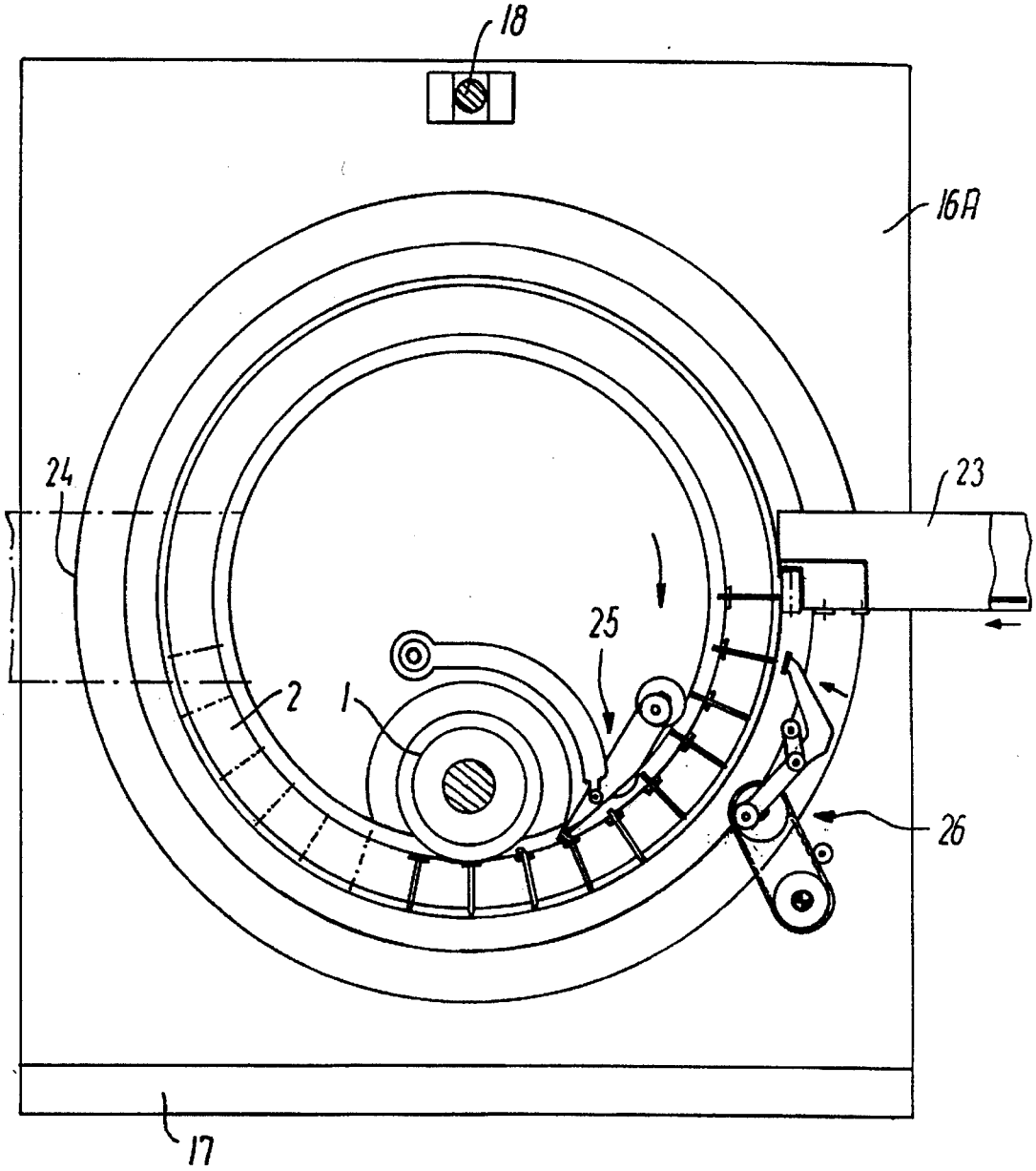
FIG. 6 shows the same machine in a side view along the line VI—VI in FIG. 5.

FIG. 5 and 6 schematically show the machine, according to the invention, in a vertical, transverse sectional view and in a side view, respectively.

The tool ring 2 includes, as seen in FIG. 5, two mutually inclined tool rings 2A and 2B secured to respective inner rings 14A and 14B that may be ball or roller bearings. The outer rings 15A and 15B, respectively, of said bearings are secured to associated supporting plates 16A and 16B, respectively.

The inner ring 14A of the tool ring 2A has an internal toothing 11 axially clearing the sides of the roll 1 and being engaged with a toothed drive 12 driven by a motor 13. The roll 1 may be driven separately or by rolling on the inside of the tool ring 2A,B.

The plate 16A is rigidly attached to a base plate 17 so that the plates 16A and 16B may be urged against each other by means of a bolt 18 and a hinge 19. The roll is secured to a shaft 20 rotatably mounted to the plates 16A and 16B, respectively, by means of bearings 21A and 21B, respectively The shanks 3 are secured in the tool rings 2A,B by means of splitted tools or mould jaws 22A and 22B, respectively, and inserted radially in these jaws at a schematically shown station 23 where the straightening, cutting and pointing of the raw material in form of a wire also is performed. At the station 23 the jaws 22A,B are open so that they can receive the shank. When the tool ring 2A,B turns in the direction of the arrow the two jaws 22A,B will be brought nearer to each other owing to the inclination between the tool ring 2A and the tool ring 2B. When the shank 3 in the tool ring is turned to the area at the roll 1 the jaws 22A,B will clamp the shank tightly so that the shank cannot move in the jaws during forming of the head.

The finished nails are removed at another schematically shown station 24 from where they are taken to a location for packing and storing.

In FIG. 6 also is shown a punching device 25 for pre-bending the protruding end of the shanks and a pushing device 26 for pushing on the rear end of the shanks.

Figure 7:
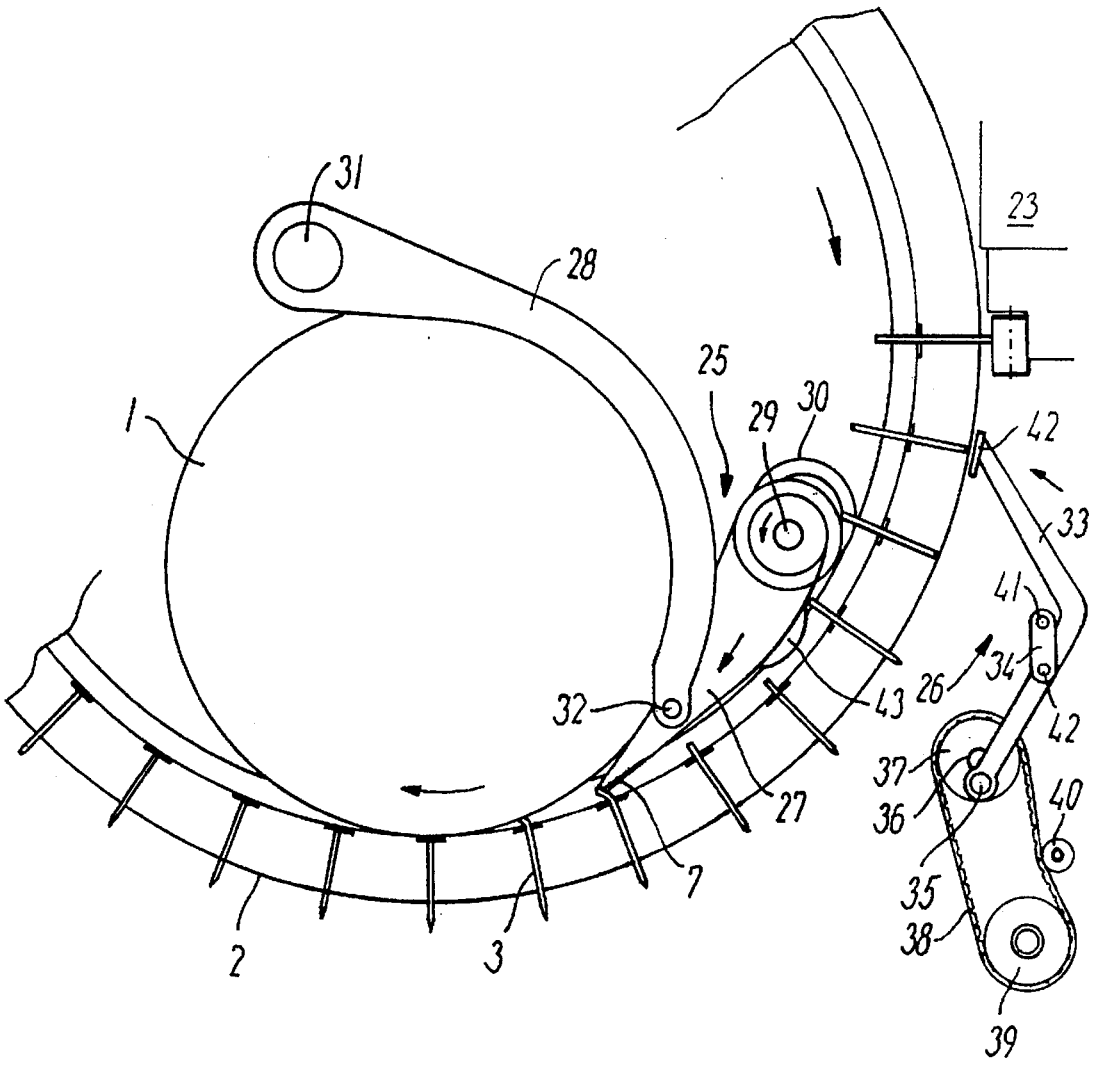
FIG. 7 is a partial side view of a first embodiment of the machine according to the invention, showing a punching device in bended position.
Figure 8:
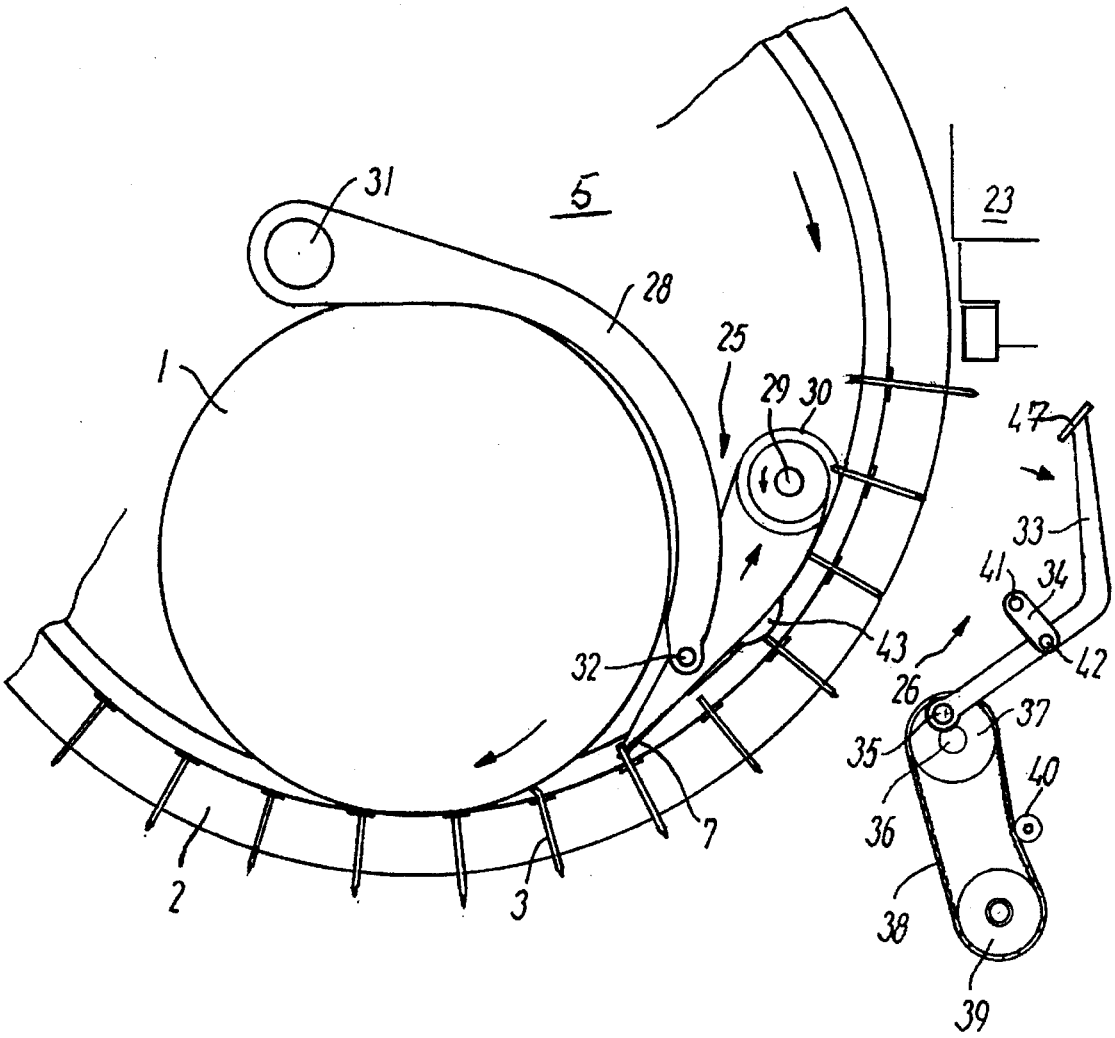
FIG. 8 shows the same, but with the punching device in a retracted position.

These devices are seen in a larger scale in FIG. 7 and 8. The punching device 25 has form of a link motion with a first lever 27 and a second lever 28. At the front end of the first lever 27 the punch 7 is mounted. At the rear end the first lever 27 can swing about a first pivot 29 mounted eccentric on a shaft 30 as can be driven separately or from the machines' driving mechanism. The second lever 28 can swing about a second pivot 31 at the rear end and at the front end about a third pivot 32 mounted on the first lever 27 between the punch 7 and the first pivot 29.

When operating the machine, the shaft 30 rotates synchronously with the conveying of the shanks clamped in the rotating tool ring and said link motion 25 then brings the punch to reciprocate between the bending position shown in FIG. 7 and the retracted position shown in FIG. 8. During the movement from the punching position to the retracted position the punch will be lifted over the succeeding shank by means of the second lever 28 and the eccentric mounted first pivot 29 of the first lever 27.

As above named, the shanks will be inserted into the open jaws 22A,B at the station 23. The conventional inserting stations, however, are normally adapted to insert shanks with a not too long protruding end. When making nails with very big heads the pushing device 26 therefore ensures that the shanks protrude with a sufficient length into the cylindrical space inside the tool ring by pushing on the rear end of the shanks.

The pushing device 26 also consists of a link motion with a first lever 33 and a second lever 34. At the rear end the first lever 33 can swing about a first pivot 35 mounted eccentric on a driven wheel 37 mounted again on a shaft 36. Said wheel 37 is via a transmission belt 38 driven by a driving wheel 39 which itself can be driven separately or from the machines driving mechanism. A belt adjuster 40 serves to keep the belt tight.

The second lever 34 can swing about a second pivot 41 at the rear end and at the front end about a third pivot 42 mounted on the first lever 33 between the first pivot 35 and a pushing shoe 47 at the front end.

When operating the machine, the driving chain wheel 39 will bring the link motion 26 to work in such a way that the first lever 33 will swing between the pushing position shown in FIG. 7 and the retracted position shown in FIG. 8 synchronously with the conveying of the shanks clamped in the rotating tool ring. In the pushing position the shoe 47 is pushing the shanks further into the tool ring following simultaneously the movement of the end of the shank in the rotary direction of the tool ring 2A,B.

For making it possible on each shank to form a head with exactly the desired wanted form and size it is necessary to insure that each shank protrudes the same length into the cylindrical space inside the tool ring. The pushing device therefore first will push the shanks a little too far into the tool ring. Later the shanks have to pass an adjusting roll 43 situated upstreams the roll 1. The adjusting roll 43 will then press the shanks back again into the jaws 22A,B so that all shanks will have protruding ends with the same height, namely the height up to the adjusting roll 43.

Figure 9:
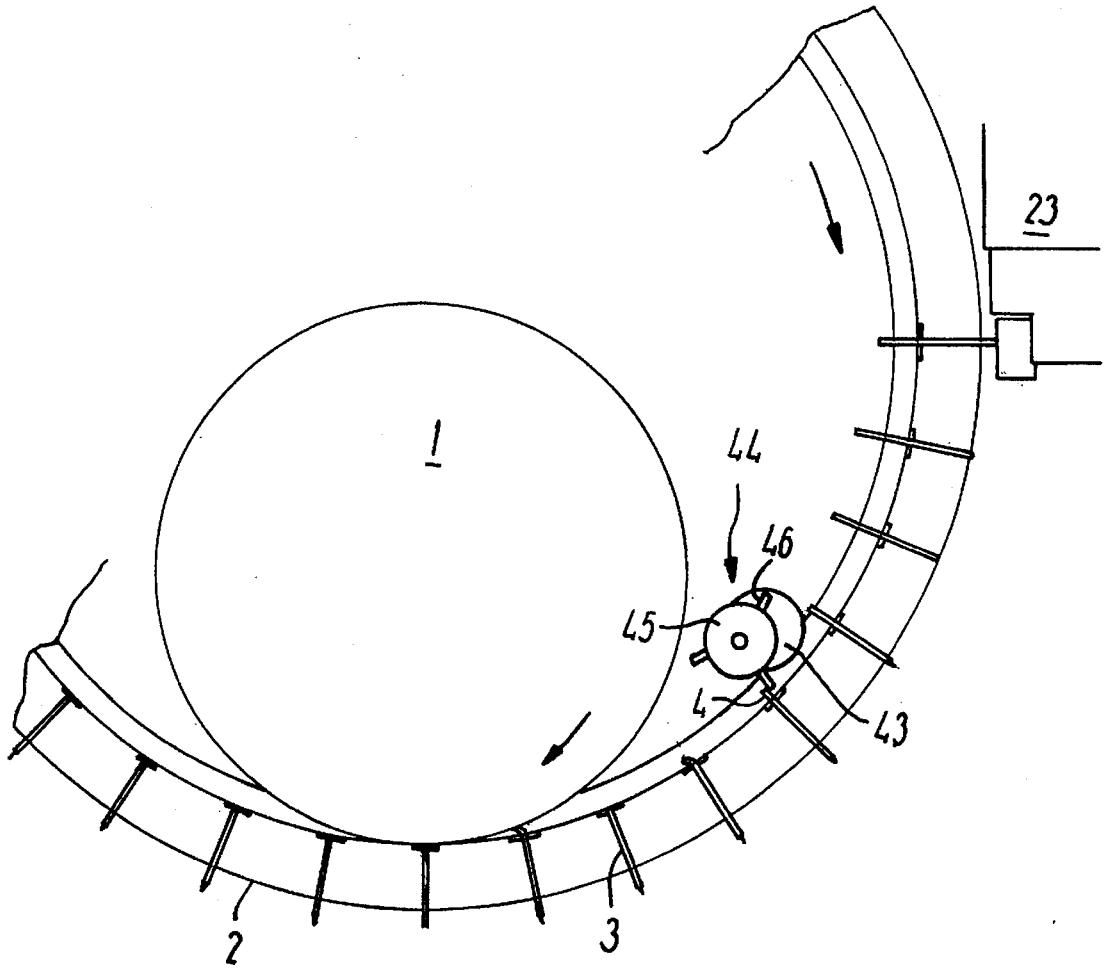
FIG. 9 is a partial side view of a second embodiment of the machine according to the invention.

FIG. 9 shows another embodiment for a punching device 44 operating in the same machine as shown in FIG. 8 and 9. This embodiment is very cheap and simple as it consists only of a rotatable shaft 45 with three radially extending projections 46 acting as punches. When the shaft 45 is rotated synchronously with the conveying of the shanks clamped in the rotating tool ring the three punches 46 alternately will bend the protruding end 4 of the shanks 3.

I claim:

1. A machine for providing each of a plurality of oblong shanks with an enlarged head in one end thereof, said machine comprising:

a) a rotatable tool ring bounding a substantially cylindrical space and having a plurality of holding tools for receiving the shanks in a receiving position of the machine and for securing the shanks so that they extend substantially radially of the tool ring with each of the shanks having its said one end protruding into the cylindrical space in a securing position of the machine, said tool ring being rotatable in a rotating direction in which each of the holding tools conveys a respective one of the shanks from the receiving position to the securing position;

b) a rotatable roll mounted in the cylindrical space at the securing position for deforming the protruding end of each of the shanks successively to provide an enlarged head on each of the shanks; and c) a bending device mounted in the cylindrical space between the receiving position and the rotatable roll for bending the protruding end of each of the shanks.

2. A machine according to claim 1, wherein the bending device is adapted to bend the protruding end of the shanks at an angle in the same direction as the rotating direction of the tool ring.

3. A machine according to claim 1, wherein the bending device is adapted to bend the protruding end of each of the shanks at an angle between 5 and 45 degrees.

4. A machine according to claim 1, wherein the bending device comprises a punch guided for movement between a first position where the punch acts on the protruding end of one of the shanks and a second position where the punch is clear of the shanks.

5. A machine according to claim 4, wherein the punch is situated close to the roll.

6. A machine according to claim 4, wherein the punch is a radially extending projection on a shaft having a center line parallel with a center line of the tool ring and adapted to rotate synchronously with conveyance of the shanks from the receiving position to the securing position.

7. A machine according to claim 4, wherein the punch is mounted on a guiding device adapted to impart a mainly reciprocating movement to the punch synchronously with conveyance of the shanks from the receiving position to the securing position.

8. A machine according to claim 7, wherein the guiding device is a link motion.

9. A machine according to claim 8, wherein the link motion comprises a first lever having the punch at one end, and mounted at the other end a pivot attached eccentrically on a shaft adapted to rotate synchronously with conveyance of the shanks from the receiving position to the securing position, and a second lever having mounted at one end a pivot on the first lever near the punch and at the other end a pivot attached to a fixed part of the machine.

10. A machine according to claim 1, wherein a peripheral velocity of the roll is between 0% and 12% more than a velocity of the enlarged head of each of the shanks when these are secured in the holding tools.

11. A machine according to claim 1, wherein a pushing device mounted on a side opposite-the cylindrical space of the tool ring between the receiving position and the securing position is adapted to push on a rear end of each of the shanks for increasing the length of the protruding end of each of the shanks.

12. A machine according to claim 1, wherein the bending device is adapted to bend the protruding end of each of the shanks at an angle between 5 and 15 degrees.

13. A machine according to claim 1 wherein the oblong shanks provided with enlarged heads are nails.

* * * * *